US006515386B2

(12) United States Patent
Jacobsen

(10) Patent No.: US 6,515,386 B2
(45) Date of Patent: Feb. 4, 2003

(54) MOTOR CONSTRUCTION UNIT FOR A SUBMERSIBLE PUMP UNIT

(75) Inventor: John Bjerregard Jacobsen, Bjerringbro (DK)

(73) Assignee: Grunfos A/S, Bjerringbro (DK)

( * ) Notice: Subject to any disclaimer, the term of this patent is extended or adjusted under 35 U.S.C. 154(b) by 0 days.

(21) Appl. No.: 09/799,434

(22) Filed: Mar. 5, 2001

(65) Prior Publication Data

US 2001/0033114 A1 Oct. 25, 2001

(30) Foreign Application Priority Data

Mar. 6, 2000 (DE) ..... 100 10 961

(51) Int. Cl.[7] ..... H02K 9/00; F04D 29/58

(52) U.S. Cl. ..... 310/87; 310/64; 310/67 R; 310/68 R; 310/89; 417/423.3

(58) Field of Search ..... 310/87, 88, 64, 310/89, 68 R, 67 R; 417/410.1, 423.14, 423.3

(56) References Cited

U.S. PATENT DOCUMENTS 4,981,420 A 1/1991 Jensen et al.
5,028,218 A 7/1991 Jensen et al.
5,714,816 A * 2/1998 Jensen et al. ..... 310/89
6,022,196 A 2/2000 Jensen et al.

FOREIGN PATENT DOCUMENTS

DE 3642727 * 6/1988 ..... F04D/13/06

* cited by examiner

*Primary Examiner*—Burton S. Mullins
(74) *Attorney, Agent, or Firm*—Cohen, Pontani, Lieberman & Pavane

(57) ABSTRACT

The motor construction unit is provided for a submersible pump unit and comprises an electric motor with a frequency converter connected in series which are arranged in a common housing casing round in cross section. The frequency converter is as an insert arranged axially flush to the motor and consists essentially of three components, specifically of a common semiconductor element containing the power part, of a component containing the input and intermediate circuit and a component containing the 3 control and regulation electronics. The component containing the power electronics is via a heat distributor connected to the housing casing. The neat distributor is in its outer contour adapted to the inner contour of the housing casing and is pressed into this for heat conduction over the whole periphery.

16 Claims, 1 Drawing Sheet

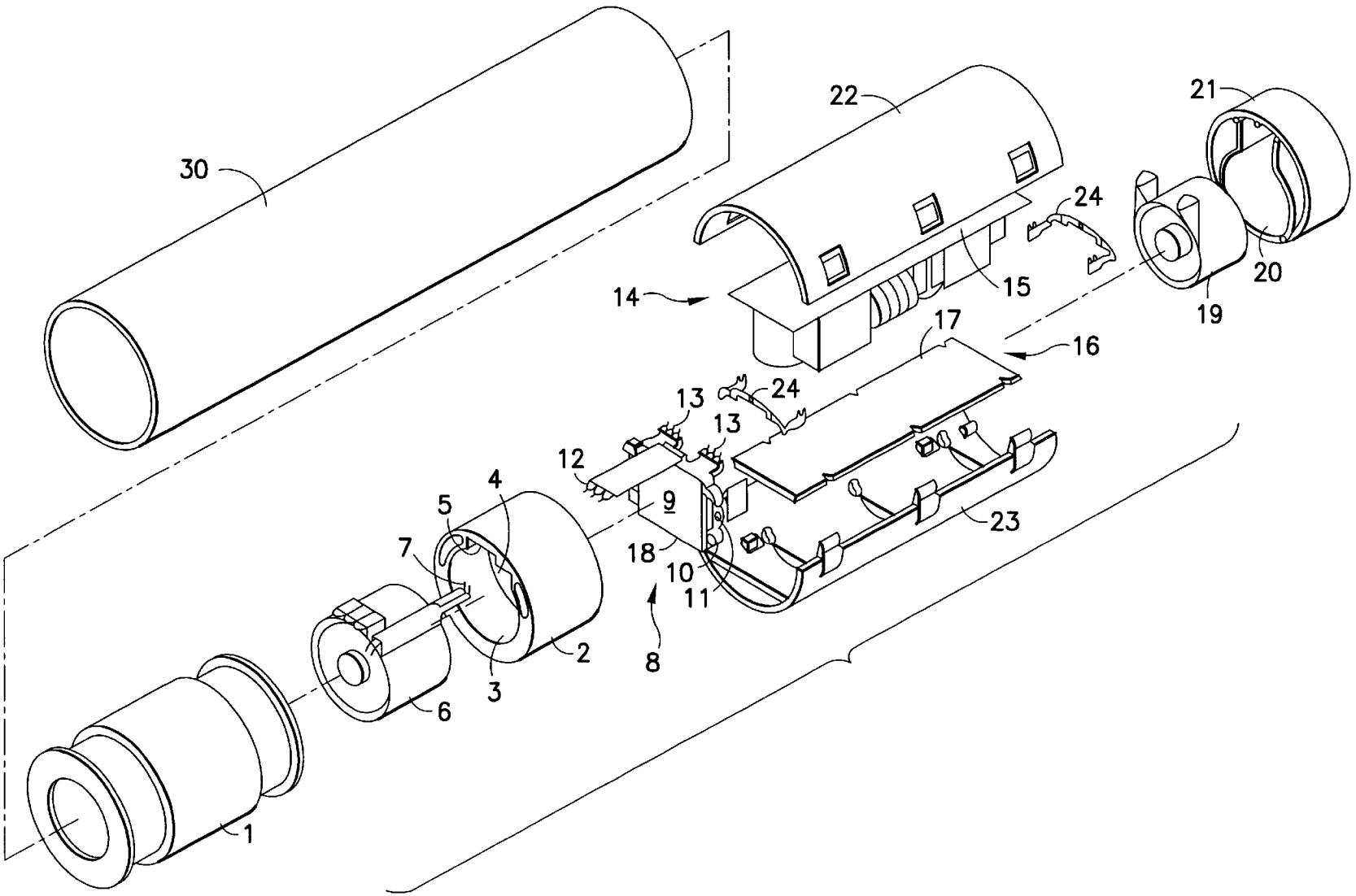
21
20
19
24
16
15
17
23
22
24
13
13
14
9
10
11
18
8
12
2
4
3
5
7
6
30
1

MOTOR CONSTRUCTION UNIT FOR A SUBMERSIBLE PUMP UNIT

BACKGROUND OF THE INVENTION

1. Field of the Invention

The invention relates to a motor construction unit for a submersible pump unit with an electric motor and a frequency converter connected in series, the frequency converter being arranged flush to the motor and having a first component including a power part, a second component including an intermediate circuit, and a third component including control electronics. A housing casing receives the frequency converter therein as an insert, the housing casing having an inner contour with a circular cross-section.

2. Description of the Related Art

Motor construction units of this type are used for submersible pump units which have a slimline and essentially cylindrical shape and are essentially cylindrical shape and are adapted to the predetermined restricted bore-hole dimensions. Such submersible pump units are for example known from DE 38 20 005 , to which U.S. Pat. No. 4,981,420 corresponds and EP 0 346 730 , to which U.S. Pat. No. 5,028,218 corresponds. With these submersible pump units there is integrated a frequency converter which allows the pump unit to be driven at high speed independently of the frequency and voltage of the electrical supply network and thus to achieve a high delivery output also with a comparatively small tube diameter or unit diameter.

A certain problem with such units which comprise an integrated frequency converter is to regularly lead away the waste heat arising in the power part of the frequency converter. With the pumps according to the initially mentioned state of the art this is effected via the delivery medium by forming within the unit a part-flow which is essentially used for the leading away of the heat arising in the frequency converter. The costs with respect to design required for this are quite high which is why one has also in the meantime gone over to leading away the heat not to the delivery fluid but to the housing of the unit since this is in connection with the surrounding delivery medium in a large-surfaced manner and therefore is particularly predestined for the leading away of this waste heat.

A problem is to lead away the waste heat to the housing or housing casing as a rule consisting of sheet metal. In DE 197 27 202, to which U.S. Pat. No. 6,022,196 corresponds, this is effected by allocating to the heat-producing componentry of the frequency converter elastic cushions which are filled with a heat-conducting means and which convey the heat from the corresponding componentry via the cushion to an inner housing or an inner shell which for its part is inserted into the housing casing formed of sheet metal. This construction type although it has proven itself, it is however quite complicated with regard to manufacturing technology since a shape-stable inner housing is required on which a head-conducting cushion may be supported in order to make possible an intensive heat transfer. This inner housing in manufactured of lightweight-metal profiles and as a whole together with the componentry located therein is inserted into the metallic housing casing. The latter may likewise be problematic since for achieving a large surfaced heat removal there is required a close a possible bearing of the inner housing on the housing casing which leads to high forces on inserting or pressing the inner housing into the housing casing. Since the housing casing is a formed sheet metal part which may not be retro-machined in a material-removing manner, alignment errors, even if slight, over the length of the housing are not to be completely ruled out, which may lead to considerable problems on insertion of the inner housing into the casing.

SUMMARY OF THE INVENTION

Against this state of the art it is the object of the invention to further develop a motor construction unit of the type according to the introductory part of the claim such that it is inexpensively manufacturable, in particular in large scale manufacture, and the previously outlined assemble problems are avoided.

According to the invention, a first heat distributor is heat-conductively connected to the first component, and has an outer contour which essentially corresponds to the inner contour of the housing casing and bears on the inner contour over the entire periphery of the first heat distributor.

The basic concept of the present invention is to do away with the heat-conducting contact between the inner housing and the housing casing and instead of this to provide one, or where required several heat distributors, which convey the heat directly to the housing casing. In order to achieve this the heat distributors in their outer contour are adapted to the inner contour of the housing casing so that they essentially over their whole periphery bear on the housing casing and thus ensure a large-surfaced heat transfer. Since only in the region of the heat distributor is there required a heat-conducting contact, the remaining parts of the insert may be freely configured. Thus one may largely do away with an inner housing or manufacture this of plastic or other material. Furthermore these further insert parts may be arranged with play within the housing casing which simplifies the assembly since on inserting only the friction between the heat distributor or heat distributors and the housing is to be overcome.

Preferably the head distributor is heat-conductingly connected to the first component, thus the component which contains the power part of the frequency converter is arranged at the motor-side end of the frequency converter. Power part is not necessarily to be understood as the power circuit but also where appropriate the power electronics of the input circuit. By way of this there result short conduction connections from the power part to the motor. Furthermore the conduction connections in a particularly advantageous further formation of the invention may be formed by the first component.

If on account of the constructional size of other demands further components of the frequency converter require a separate cooling, then it is useful to provide a further heat distributor which likewise essentially over its whole periphery bears on the housing casing and whose outer contour essentially corresponds to the inner contour of the housing casing. Advantageously with the provision of several heat distributors these are not arranged directly behind one another but at a significant distance to one another in order to simplify the assemble of the insert. With one embodiment which envisages two heat distributors these are advantageously arranged at both ends of the insert, where in the heat distributor for the first component, thus for the power part, is advantageously arranged next to the motor.

The first heat distributor for the power part comprises usefully a transverse wall on which the first component bears in a heat-conducting manner over a large area in order to ensure the heat removal towards the housing casing. This transverse arrangement of the first constructional unit offers particular advantages which are further described in detail below.

Apart from the first component which is usually designed as a semi-conductor component or encast semiconductor component, furthermore in particular in the coils of the frequency converter heat is set free which is to be led away. These coils of the frequency converter are preferably in each case incorporated into an axial recess of a heat distributor. Thus for example another coil may be incorporated into an axial recess provided in the heat distributor for the power part on the other side of the transverse wall.

The component which forms the intermediate circuit and which may where appropriate also comprise the input circuit or parts of the input circuit, as well as the control electronics (under this control electronics is to be understood in the broadest sense, thus also the componentry required for the control) are advantageously arranged on circuitboards which extend in the longitudinal direction of the motor construction unit. Usefully for each of the two components there is in each case provided one circuitboard. This arrangement has the particular advantage that all lead connections between the first component and the second component, between the second and the third component as well as between the first component and the third component may be formed by the first component itself. Such an arrangement is particularly favorable with regard to manufacturing and assembly technology since a large part of the lead connections within the frequency converter may be formed by the first component which considerably reduces the number of assembly steps. Furthermore by way of such an arrangement also the operational safety is improved since the number of soldering or plug connections may be reduced to a minimum. Preferably these lead connections proceeding from the first component are formed by sheet metal sections which are mechanically connected and held by way of a plastic mould body as will yet be described in detail by way of the embodiment example. This plastic mould body advantageously serves also for the fastening of the first component on the heat distributor. It may enclose or also completely accommodate the semiconductor element comprising the power part of the frequency converter.

BRIEF DESCRIPTION OF THE DRAWINGS

The invention is hereinafter described in more detail by way of one embodiment example shown in the drawing.. The sole FIGURE is an exploded perspective of the motor construction unit according to the invention.

DETAILED DESCRIPTION OF THE PREFERRED EMBODIMENT

The motor construction unit comprises a motor whose stator 1 is shown on the left. The associated rotor is not drawn in for reasons of overview. To this stator on the side distant to the drive shaft there connects a first heat distributor 2 which has the same circular outer contour as the stator 1 and is pressed flush with this into the housing casing 30. The heat distributor 2 has essentially a cylindrical shape and comprises on the side proximal to the stator 1 a recess 3 which has an essentially round cross section and is limited in its axial extension by way of a transverse wall 4. This recess 3 comprises a longitudinal channel 5 which passes through the transverse wall in the form of an essentially rectangular opening. The recess 3 is provided for receiving a coil 6 which is pressed into this recess 3 in a manner such that a good heat transfer from the coil 6 to the heat distributor 2 is effected. The coil 6 is a coil for the idle current compensation. This coil 6 is electrically connected via two connections 7 which are, led through the longitudinal channel 5, pass through the transverse wall 4 and are led out on the side of the heat distributor 2 which is distant to the stator 1. The heat produced in the coil is conveyed to the heat distributor 2 which is pressed into the cylindrical housing casing 30 consisting of sheet metal and with essentially its whole peripheral surface is heat-conductingly connected to this housing casing.

On the side of the heat distributor 2 remote from the stator 1, there is provided a relatively flat depression in the end face of the heat distributor which is limited by the transverse wall 4. This depression accommodates a first component 8 which contains the power part of the frequency converter. This component 8 comprises the six power-switches, the recovery diodes as well as the brake resistances. These are integrated in a common discrete component in the form of la semiconductor component. The electrical leads and connections of this semiconductor element are sheet metal sections which are punched or manufactured in another manner, and which are held and mechanically connected to one another in a common cast body 10. The cast body 10 surrounds the semiconductor element 9 and fixes the leads or connections formed by the sheet metal sections, of the first component 8. The cast body 10 also serves for fastening the semiconductor component 9 on the heat distributor. For this in the cast body 10 there are provided bores 11 which receive stud bolts (not shown) formed of light-weight metal. After incorporating the component 8 into the beat distributor 2, the bolts may be formed into a rivet head which connects the component 8 to the heat distributor with a positive fit. Then the semiconductor component 9 bears on the transverse wall 4 of the heat distributor 2 in a large-surfaced manner.

The first component 8 comprises connections 12 aligned to the stator 1 which are bent up out of the plane of the semiconductor component 9 by 90° and also in this bent-up region are enclosed by the cast body 10. These connections 12 with the part of the cast body 10 surrounding them are led via the longitudinal groove 5 up to the stator 1, thus connect the power part directly to the stator 1 of the motor.

Bent up by 90° out of the plane of the semiconductor element 9 in, the direction distant to the stator 1 are leads whose upwardly directed ends form connections 13 which connect the first component 8 comprising the power part, to a second component 14 forming the input and intermediate circuit of the frequency converter. The second component 14 is constructed on a circuitboard 15 which components in the representation according to the figure are arranged on the lower side. The connections 13 may either be designed as plug connections or also as soldering connections for the electrical connection to this circuitboard.

As is further deducted from the figure, the connections 7 of the coil 6 are designed such that these in the assembled condition lie in the region of the connections 14, by which means this coil 6 is conductingly connected to the circuitboard 15 and thus to the second component 13. The circuitboard 15 extends essentially in the axial direction of the motor construction unit.

Parallel to the circuitboard, but arranged therebelow is a third component 16 which comprises the control and regulation circuit of the frequency converter and which likewise comprises a circuitboard 17. The circuitboard 17 likewise carries the electronic components on its lower side. The electrical connection is effected via the second component 14 which at the side which is distant to the first heat distributor 2 comprises suitable (non-shown) lead connections. On this side also a coil 19 is electrically connected to the circuitboard 17. The coil itself is however not arranged on the circuitboard 17 but next to it and is seated in a recess 20 of a second heat distributor 21 which likewise is pressed into the housing casing 30 and with its whole outer periphery bears on this for the purpose of heat conduction. The coil 19 is incorporated into the recess 20 in a heat-conducting manner in order to convey the heat arising here via the heat distributor 21 to the housing casing and thus to the surrounding delivery medium. The coil 19 is an EMC coil.

The circuitboards 15 and 17 are in each case incorporated and supported in half shells 22 and 23 which consist of plastic and with the incorporation of the previously mentioned circuitboards form an essentially cylindrical inner housing whose diameter is slightly smaller than the housing casing so that this section for this may be inserted into the housing casing in a friction-free manner. The bow 24 provides for grounding since the inner housing is not conducting. The half shells 22 and 23 form an inner housing which with the heat conductor 2 on the side proximal to the stator 1 and with the heat distributor 21 on the side distant to the stator forms an insert unit which as a whole is pressed into the housing casing. Since this unit bears on the housing casing in a heat-conducting manner only at the ends, specifically in the region of the heat distribution 2 and 21, the pressing-in procedure is possible with relatively low force since any alignment errors of the housing casing are compensated by way of the play of the inner housing therebetween. The connection lead to the mains connection is led through the heat distributor 21 and that to the motor through the heat distributor 2. The previously described insert unit is constructed with a minimum of components and is in particular suitable for the manufacture and automatic assembly in the medium scale and large scale manufacture.

What is claimed is:

1. A motor construction for a submersible pump unit, said motor construction comprising an electric motor, a frequency converter connected in series to said motor and being arranged flush to said motor, said frequency converter comprising a first component comprising a power part, a second component comprising an intermediate circuit, and a third component comprising control electronics, a housing casing having an inner contour with a circular cross section, said housing casing receiving said frequency converter therein as an insert, and a first heat distributor having an outer contour with a circular cross-section and a central axis, said outer contour essentially corresponding to the inner contour of the housing casing and bearing on the inner contour over the entire periphery of the first heat distributor, said first heat distributor further comprising a transverse wall extending transversely of said central axis, said first component bearing on said transverse wall in a heat conducting manner.

2. A motor construction unit according to claim 1, wherein the first heat distributor which is heat conductingly connected to the first component, is arranged axially adjacent to the motor.

3. A motor construction unit according to claim 1, wherein the second component further comprises an input circuit.

4. A motor construction unit according to claim 1 further comprising a second heat distributor having an outer contour with a circular cross-section and a central axis, said outer contour essentially corresponding to the inner contour of the housing casing and bearing on the inner contour over the entire periphery of the second heat distributor.

5. A motor construction unit according to claim 4, wherein the heat distributors are arranged at ends, axially distant from one another, of the frequency converter.

6. A motor construction unit according to claim 4, wherein the heat distributors are pressed into the housing casing.

7. A motor construction unit according to claim 4, wherein at least one of said heat distributors comprises an axial recess for receiving a coil.

8. A motor construction unit according to claim 4, wherein the second component comprises a circuitboard which extends in the axial direction of the motor construction unit.

9. A motor construction unit according to claim 8, wherein the third component comprises a circuitboard which extends in the axial direction of the motor construction unit.

10. A motor construction unit according to claim 9, wherein the circuitboards of the control electronics and of the intermediate circuit are arranged between the heat distributors, preferably lying over one another.

11. A motor construction unit according to claim 1, wherein the first heat distributor comprises a transverse wall on which the first component bears in a heat-conducting manner.

12. A motor construction unit according to claim 1, wherein the first component comprises electrical connections formed by sheet metal sections which are held by a plastic body cast with the first component, and wherein the first component by way of the plastic body is fastened on the first heat distributor.

13. A motor construction unit according to claim 1, wherein the first component comprises electrical connections to the second component and to the third component, as well as lead connections to the motor.

14. A motor construction unit according to claim 1 wherein said first heat distributor is received in said housing casing in a press-fit.

15. A motor construction unit according to claim 1 wherein said first heat distributor has an axial recess for receiving a coil, said axial recess facing oppositely from said frequency converter.

16. A motor construction for a submersible pump unit, said motor construction comprising an electric motor, a frequency converter connected in series to said motor and being arranged flush to said motor, said frequency converter comprising a first component comprising a power part and electrical connections formed by sheet metal sections which are held by a plastic body cast with the first component, a second component comprising an intermediate circuit, and a third component comprising control electronics, a housing casing having an inner contour with a circular cross section, said housing casing receiving said frequency converter therein as an insert, and a first heat distributor which is fastened to said plastic body and heat-conductively connected to said first component, said first heat distributor having an outer contour which essentially, corresponds to the inner contour of the housing casing and bears on the inner contour over the entire periphery of the first heat distributor.

* * * * *